US007515026B1

(12) United States Patent
Liu et al.

(10) Patent No.: US 7,515,026 B1
(45) Date of Patent: Apr. 7, 2009

(54) STRUCTURE OF TRANSFORMER

(75) Inventors: Tzu-Yang Liu, Taoyuan Hsien (TW); Ching-Hsien Teng, Taoyuan Hsien (TW); Hsin-Wei Tsai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/036,921

(22) Filed: Feb. 25, 2008

(30) Foreign Application Priority Data

Dec. 17, 2007 (TW) ..... 96148326 A

(51) Int. Cl.
*H01F 27/29* (2006.01)
*H01F 27/30* (2006.01)

(52) U.S. Cl. ..... 336/192; 336/198; 336/208

(58) Field of Classification Search ..... 336/208, 336/198, 192, 200
See application file for complete search history.

(56) References Cited

U.S. PATENT DOCUMENTS 4,857,876 A * 8/1989 Costa ..... 336/165
4,857,878 A * 8/1989 Eng et al. ..... 336/192
6,518,870 B2 * 2/2003 Yeh et al. ..... 336/198
7,199,694 B2 * 4/2007 Hao ..... 336/208
7,345,565 B2 * 3/2008 Yang et al. ..... 336/200
2006/0006974 A1 * 1/2006 Yang et al. ..... 336/208
2007/0030190 A1 * 2/2007 Lee ..... 341/155

* cited by examiner

*Primary Examiner*—Anh T Mai
(74) *Attorney, Agent, or Firm*—Kirton & McConkie; Evan R. Witt

(57) ABSTRACT

A transformer includes a first bobbin piece, a second bobbin piece, a first pin, a second pin and a magnetic core assembly. A primary winding coil is wound on the first bobbin piece. The second bobbin piece includes a first secondary side plate, a second secondary side plate, a plurality of partition plates, a wall portion, and a secondary base. A secondary winding coil is wound on the second bobbin piece. The second pin includes a wire-arranging part, an insertion part and an intermediate part. The wire-arranging part is protruded from the second secondary side plate. The intermediate part is buried in the wall portion. The insertion part is protruded from the bottom surface of the secondary base. A first terminal of the secondary winding coil is fixed on the first pin. A second terminal of the secondary winding coil is fixed on the wire-arranging part of the second pin.

20 Claims, 9 Drawing Sheets

STRUCTURE OF TRANSFORMER

FIELD OF THE INVENTION

The present invention relates to a structure of a transformer, and more particularly to a transformer for avoiding reduced high-voltage spark or short circuit.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wounded around a winding section 121 of the bobbin 12. A tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wounded around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the power supply system of the new-generation electric products (e.g. LCD televisions), the transformers with leakage inductance prevail. For electrical safety, the primary winding coil and the secondary winding coil of this transformer are separated by a partition element of the bobbin. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

As the size of the LCD panel is gradually increased, the length and the number of the lamps included in the LCD panel are increased and thus a higher driving voltage is required. Referring to FIG. 2, a schematic exploded view of a transformer used in the conventional LCD panels is illustrated. The transformer 2 of FIG. 2 principally comprises a magnetic core assembly 21, a first bobbin piece 22, a second bobbin piece 23, a primary winding coil 24 and a secondary winding coil 25. The first bobbin piece 22 has a first side plate 26. The second bobbin piece 23 has a second side plate 27 and a plurality of partition plates 23*a*. Several winding sections 23*b* are defined by any two adjacent partition plates 23*a*. According to voltage dividing principle, the number of winding sections 23*b* may be varied depending on the voltage magnitude. In addition, a first base 26*a* and a second base 27*a* are extended from the first side plate 26 and the second side plate 27, respectively. Several pins 28 and 29 are respectively arranged on the bottom surfaces of the first base 26*a* and the second base 27*a*.

For winding the primary winding coil 24 on the first bobbin piece 22, a first terminal of the primary winding coil 24 is firstly soldered on a pin 28*a* under the first base 26*a*. The primary winding coil 24 is then successively wound on the first bobbin piece 22 in the direction distant from the first side plate 26. Afterward, a second terminal of the primary winding coil 24 is returned to be soldered onto another pin 28*b* under the first base 26*a*. For winding the secondary winding coil 25 on the second bobbin piece 23, a first terminal of the secondary winding coil 25 is firstly soldered on a pin 29*a* under the second base 27*a*. The secondary winding coil 25 is then successively wound on the winding sections 23*b* of the second bobbin piece 23 in the direction distant from the second side plate 27. Afterward, a second terminal of the secondary winding coil 25 is returned to be soldered onto another pin 29*b* under the second base 27*a*. Moreover, due to the partition plate 23*a* of the second bobbin piece 23, the primary winding coil 24 is separated from the secondary winding coil 25, thereby maintaining an electrical safety distance and increasing leakage inductance of the transformer.

The winding structure of the transformer 2, however, still has some drawbacks. For example, since the second terminals of the primary winding coil 24 and the secondary winding coil 25 are returned to be soldered onto the pins 28*b* and 29*b* under the first base 26*a* and the second base 27*a*, respectively, portions of these second terminals are disposed under the primary winding coil 24 wound on the first bobbin piece 22 and the secondary winding coil 25 wound on the second bobbin piece 23. Even if the second terminals are covered by insulating material, the creepage distance is insufficient. Under this circumstance, the transformer 2 is readily suffered from high-voltage spark or short circuit and eventually has a breakdown.

Therefore, there is a need of providing a transformer for avoiding high-voltage spark or short circuit so as to obviate the drawbacks encountered from the prior art.

SUMMARY OF THE INVENTION

It is an object of the present invention to provide a transformer for avoiding high-voltage spark or short circuit so as to prevent damage of the transformer.

In accordance with an aspect of the present invention, there is provided a transformer. The transformer includes a first bobbin piece, a second bobbin piece, a first pin, a second pin and a magnetic core assembly. The first bobbin piece has a first channel therein. A primary winding coil is wound on the first bobbin piece. The second bobbin piece includes a first secondary side plate, a second secondary side plate opposed to the first secondary side plate, a plurality of partition plates between the first secondary side plate and the second secondary side plate, a wall portion between every two adjacent partition plates, and a secondary base extended from an edge of the first secondary side plate. A secondary winding section is defined by every two adjacent partition plates for winding a secondary winding coil thereon. A second channel is defined within the wall portion. The first pin is arranged on a bottom surface of the secondary base. The second pin includes a wire-arranging part, an insertion part and an intermediate part between the wire-arranging part and the insertion part. The wire-arranging part is protruded from the second secondary side plate. The intermediate part is buried in the wall portion. The insertion part is protruded from the bottom surface of the secondary base. A first terminal of the secondary winding coil is fixed on the first pin and a second terminal of the secondary winding coil is fixed on the wire-arranging part of the second pin. The magnetic core assembly is embedded within the first channel of the first bobbin piece and the second channel of the second bobbin piece.

In accordance with another aspect of the present invention, there is provided a bobbin assembly. The bobbin assembly comprises a first bobbin piece having a primary side plate, a primary base, a primary winding section and a first channel, wherein the primary base is extended from an edge of the primary side plate. The bobbin assembly further comprises a second bobbin piece comprising a first secondary side plate, a second secondary side plate opposed to the first secondary side plate, a plurality of partition plates between the first secondary side plate and the second secondary side plate, a wall portion between every two adjacent partition plates, and a secondary base extended from an edge of the first secondary side plate, wherein a secondary winding section is defined by every two adjacent partition plates, and a second channel is defined within the wall portion; a first pin arranged on a bottom surface of the secondary base; and a second pin including a wire-arranging part, an insertion part and an intermediate part between the wire-arranging part and the insertion part, wherein the wire-arranging part is protruded from the second secondary side plate, the intermediate part is buried in the wall portion, the insertion part is protruded from the bottom surface of the secondary base.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
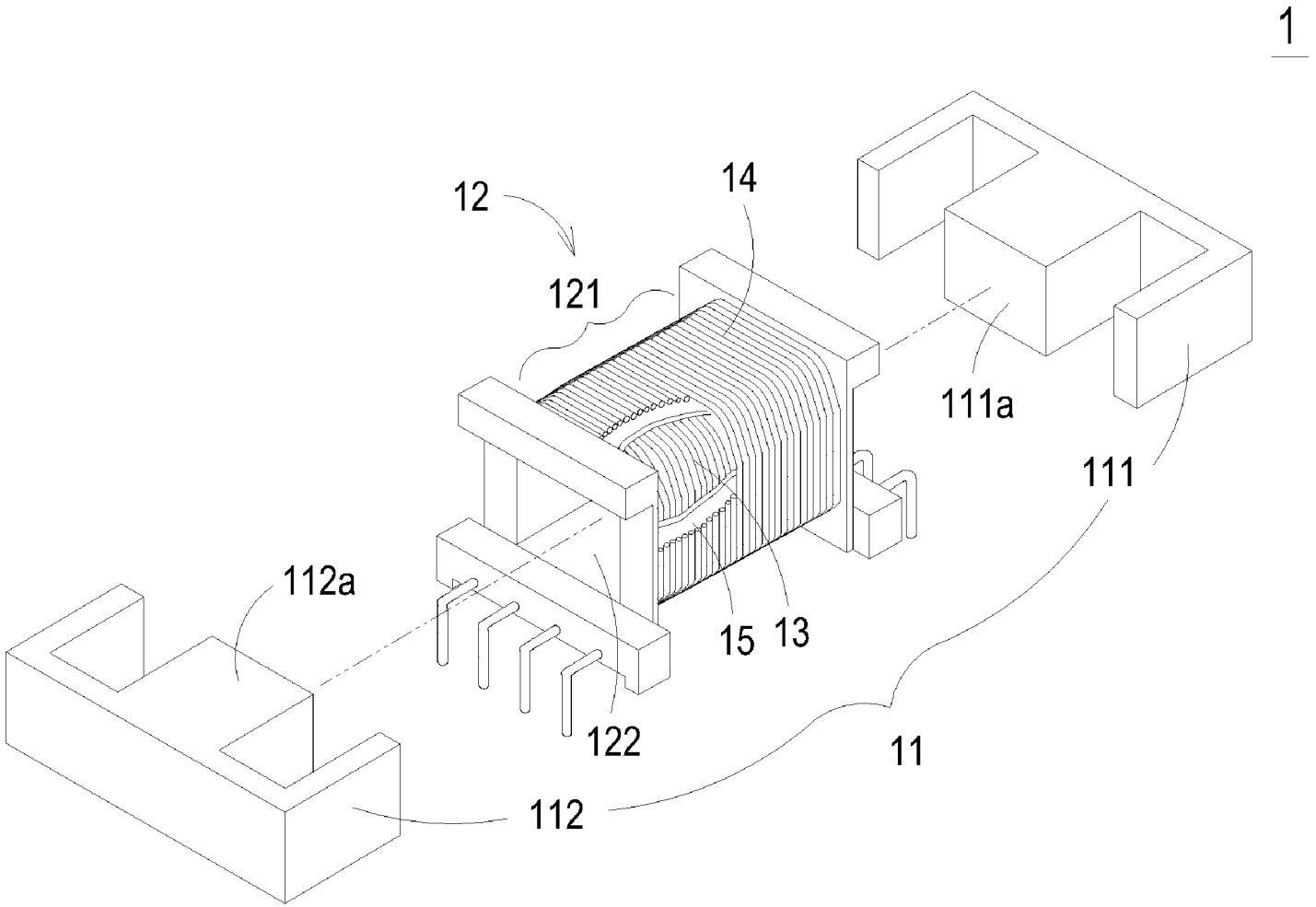
FIG. 1 PRIOR ART
FIG. 1 is a schematic exploded view of a conventional transformer.
Figure 2:
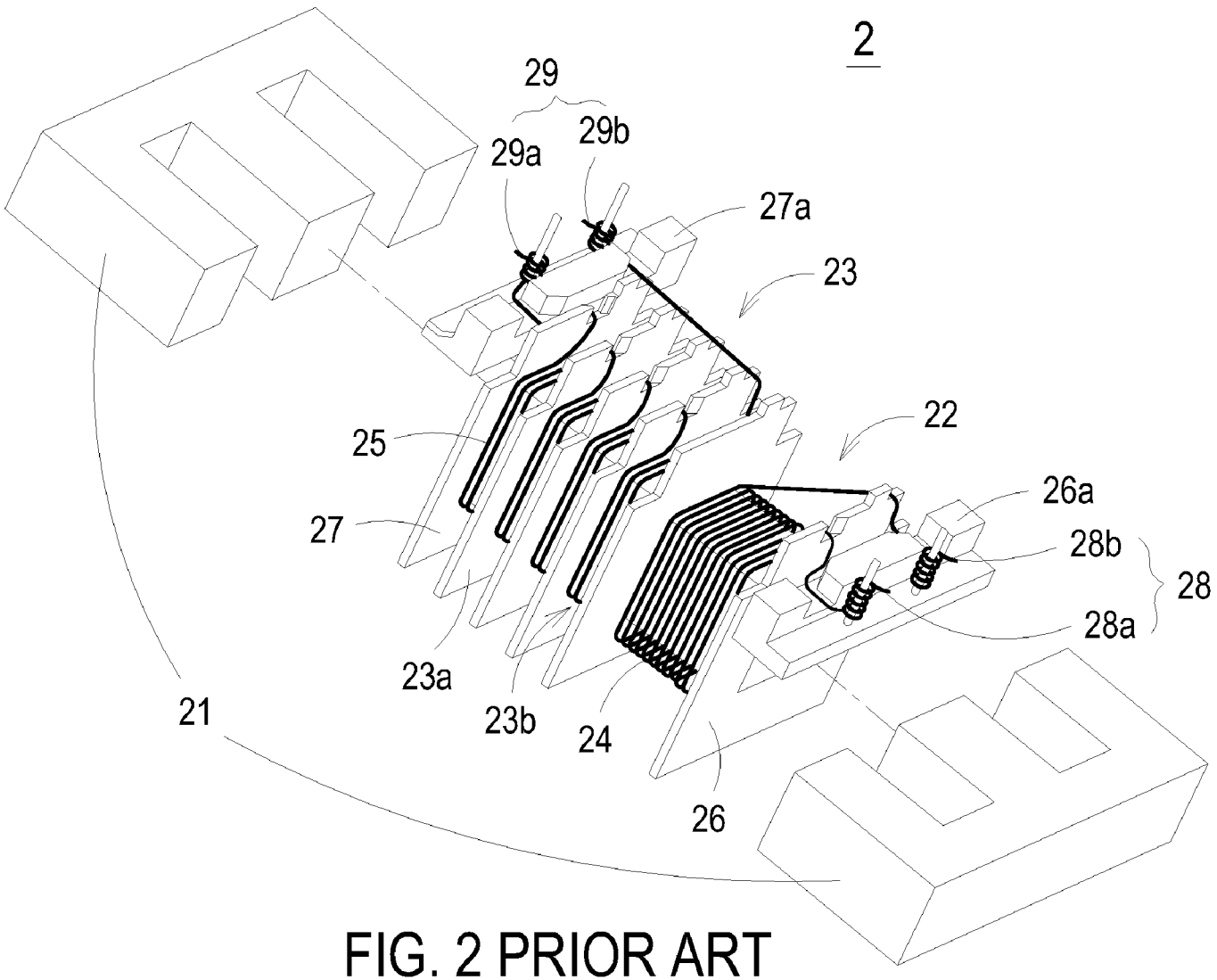
FIG. 2 PRIOR ART
FIG. 2 is a schematic exploded view illustrating a transformer used in the conventional LCD panels.
Figure 3:
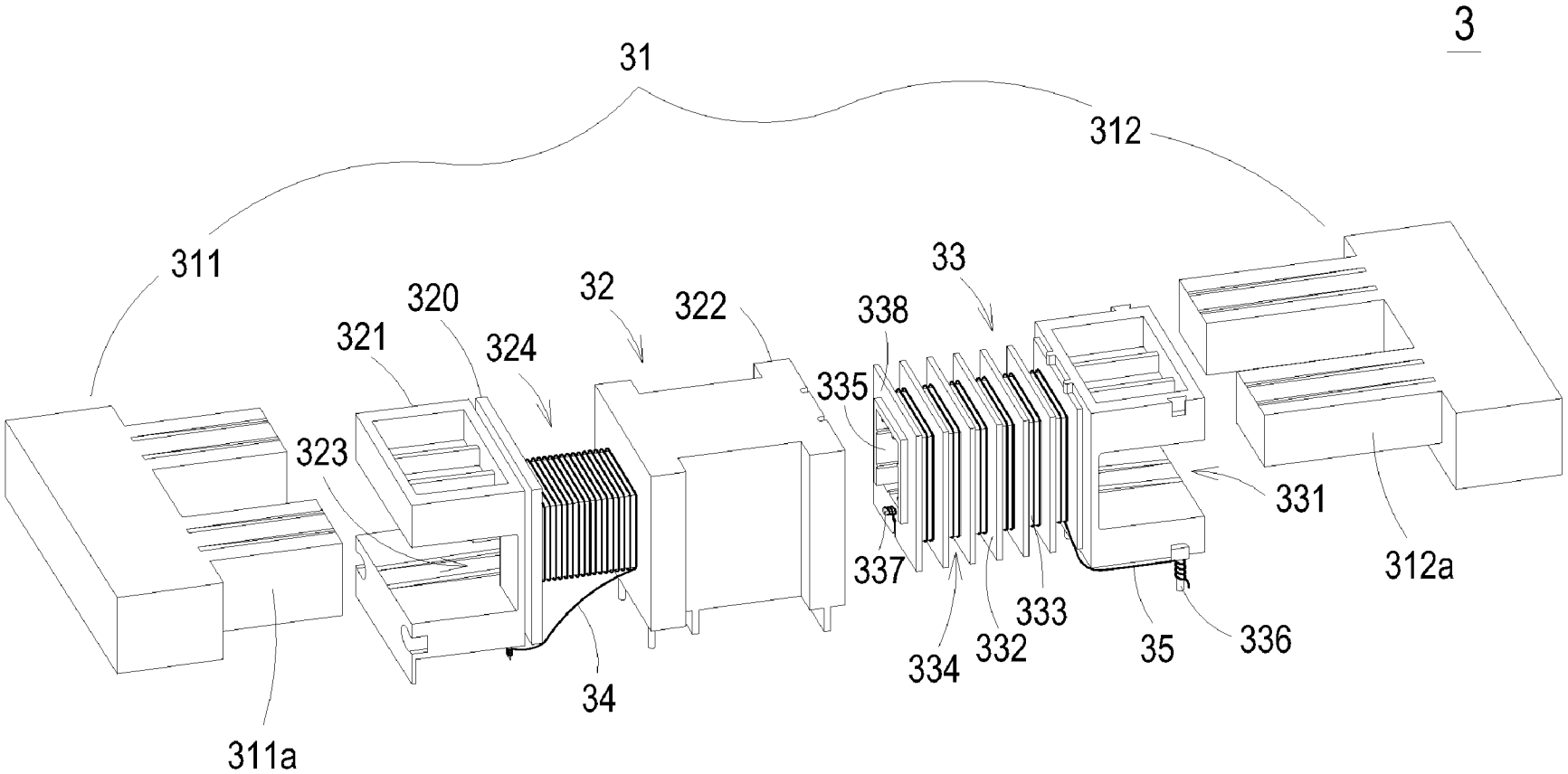
FIG. 3 is a schematic exploded view of a transformer according to a first preferred embodiment of the present invention.

Referring to FIG. 3, a schematic exploded view of a transformer according to a first preferred embodiment of the present invention is illustrated. The transformer 3 of FIG. 3 principally comprises a magnetic core assembly 31, a first bobbin piece 32, a second bobbin piece 33, a primary winding coil 34 and a secondary winding coil 35. The magnetic core assembly 31 includes a first magnetic part 311 and a second magnetic part 312. The first leg 311*a* of the first magnetic part 311 and the first leg 312*a* of the second magnetic part 312 are arranged inside the first bobbin piece 32 and the second bobbin piece 33, respectively. The primary winding coil 34 and the secondary winding coil 35 interact with the magnetic core assembly 31 to achieve the purpose of voltage regulation.

The first bobbin piece 32 includes primary side plate 320, a primary base 321, a covering element 322 and a first channel 323. A primary winding section 324 is defined between the primary side plate 320 and the covering element 322 such that the primary winding coil 34 can be wound on the primary winding section 324. It is preferred that the covering element 322, the primary winding section 324, the primary side plate 320 and the primary base 321 are integrally formed. The primary base 321 is extended from an edge of the primary side plate 320. The covering element 322 is substantially a tube structure having a receptacle (not shown) therein. The first channel 323 penetrates through the primary base 321, the primary side plate 320 and the primary winding section 324 and communicated with the receptacle of the covering element 322.

Figure 4A:
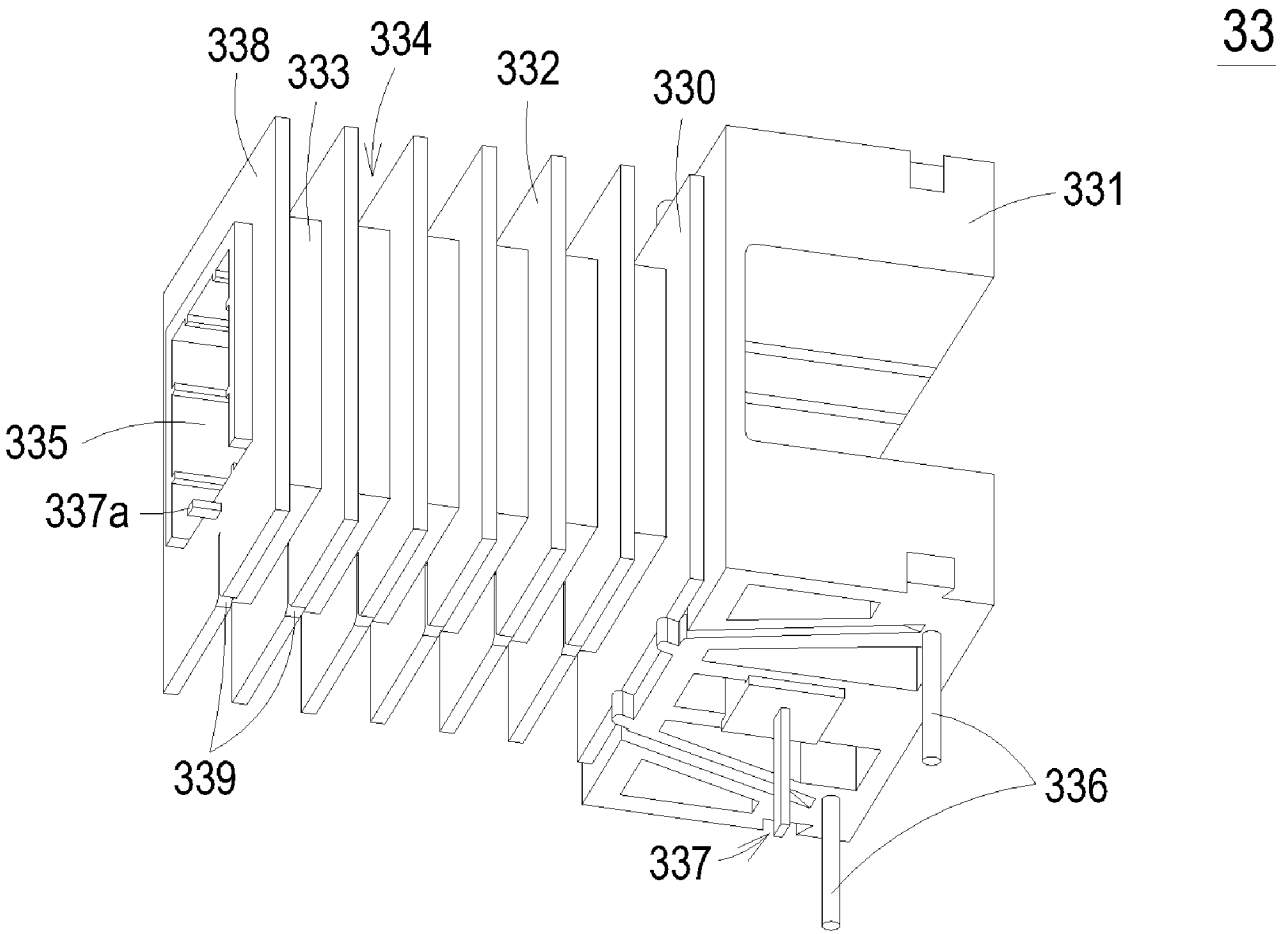
FIG. 4A is a schematic perspective view of the second bobbin piece shown in FIG. 3.

FIG. 4A is a schematic perspective view of the second bobbin piece 33 shown in FIG. 3. The second bobbin piece 33 includes a first secondary side plate 330, a second secondary side plate 338, a plurality of hollow partition plates 332, a wall portion 333 and a secondary base 331. The first secondary side plate 330, the second secondary side plate 338, the hollow partition plates 332, the wall portion 333 and the secondary base 331 have rectangular shapes. The first secondary side plate 330 and the second secondary side plate 338 are arranged on opposite sides of the second bobbin piece 33 and have apertures therein.

The hollow partition plates 332 are parallel with the first secondary side plate 330 and the second secondary side plate 338. The wall portion 333 is arranged between the first secondary side plate 330 and the neighboring hollow partition plate 332, between every two hollow partition plates 332, and between the second secondary side plate 338 and the neighboring hollow partition plate 332. The wall portion 333 is also in connection with the first secondary side plate 330, the second secondary side plate 338 and the hollow partition plates 332 so as to form a second channel therein. The first leg 312*a* of the second magnetic part 312 is embedded into the second channel. Moreover, a plurality of winding sections 334 are defined between the first secondary side plate 330, the second secondary side plate 338, the hollow partition plates 332 and the wall portion 333 for winding the secondary winding coil 535 thereon.

The secondary base 331 is extended from an edge of the first secondary side plate 330. Several first pins 336 and several second pins 337 are arranged on the bottom surface of the first secondary base 331. The first pins 336 and second pins 337 are inserted into corresponding holes in a printed circuit board (not shown).

Furthermore, the first secondary side plate 330, the second secondary side plate 338, the hollow partition plates 332 and the secondary base 331 have corresponding notches 339.

Please refer to FIG. 3 and FIG. 4A again. The receptacle of the covering element 322 is sheathed around the second secondary side plate 338 of the second bobbin piece 33 and the secondary winding coil 35 wound on the second bobbin piece 33, which will be described later. Accordingly, the primary winding coil 34 and the secondary winding coil 35 are separated from each other by the covering element 322. The first channel 323 of the first bobbin piece 32 is communicated with the second channel 335 of the second bobbin piece 33.

Figure 4B:
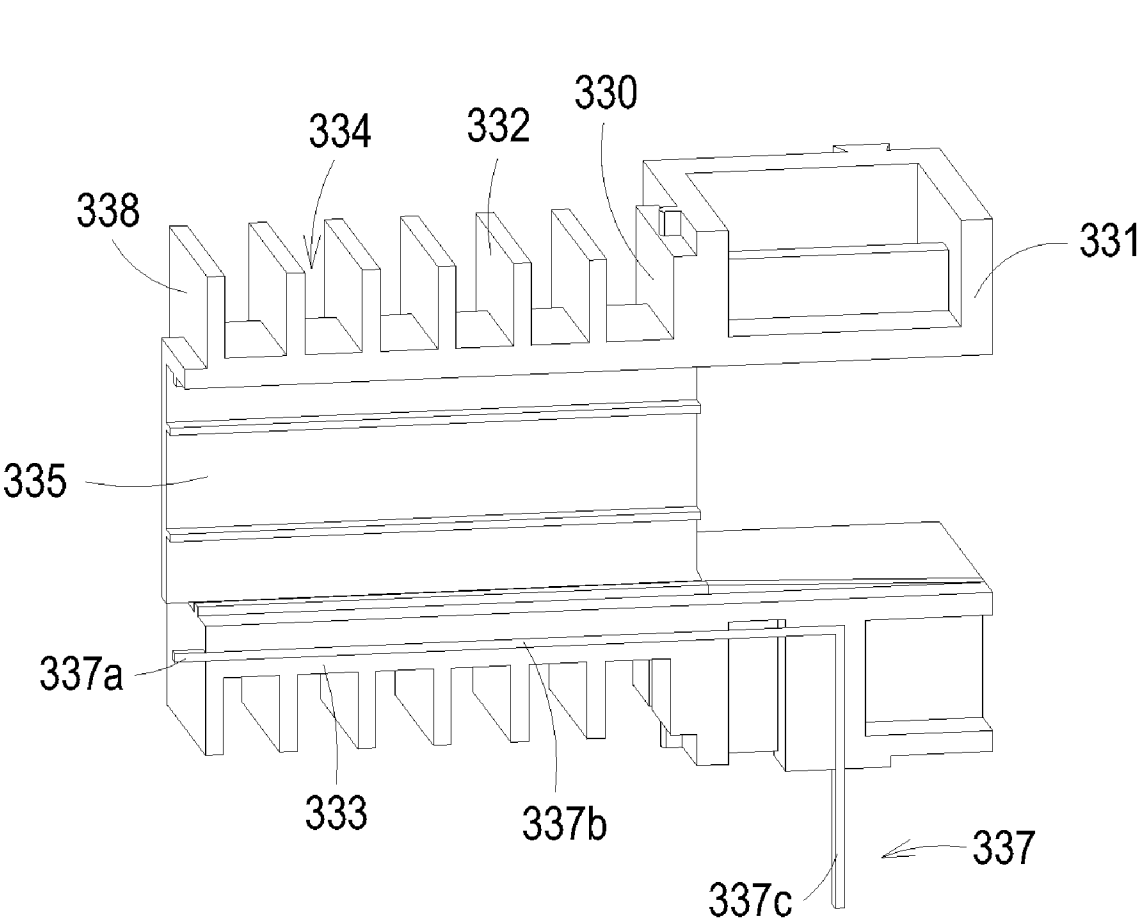
FIG. 4B is a schematic cross-sectional view of the second bobbin piece shown in FIG. 4A.

FIG. 4B is a schematic cross-sectional view of the second bobbin piece 33 shown in FIG. 4A. As shown in FIGS. 4A and 4B, the second pin 337 includes a wire-arranging part 337*a*, an intermediate part 337*b* and an insertion part 337*c*. The intermediate part 337*b* is buried in the wall portion 333 of the second bobbin piece 33 and arranged between the wire-arranging part 337*a* and the insertion part 337*c*. The intermediate part 337*b* is L-shaped. The wire-arranging part 337*a* is protruded from the second secondary side plate 338. The insertion part 337*c* is protruded from the bottom surface of the secondary base 331 to be inserted into a corresponding conductive hole of the printed circuit board, so that the transformer 3 is electrically connected to the printed circuit board. It is noted that, however, those skilled in the art will readily observe that numerous modifications and alterations of the second pin 337 may be made while retaining the teachings of the invention. For example, the shape of the intermediate part 337*b* can be varied according to the profile of the second bobbin piece 33.

Figure 4C:
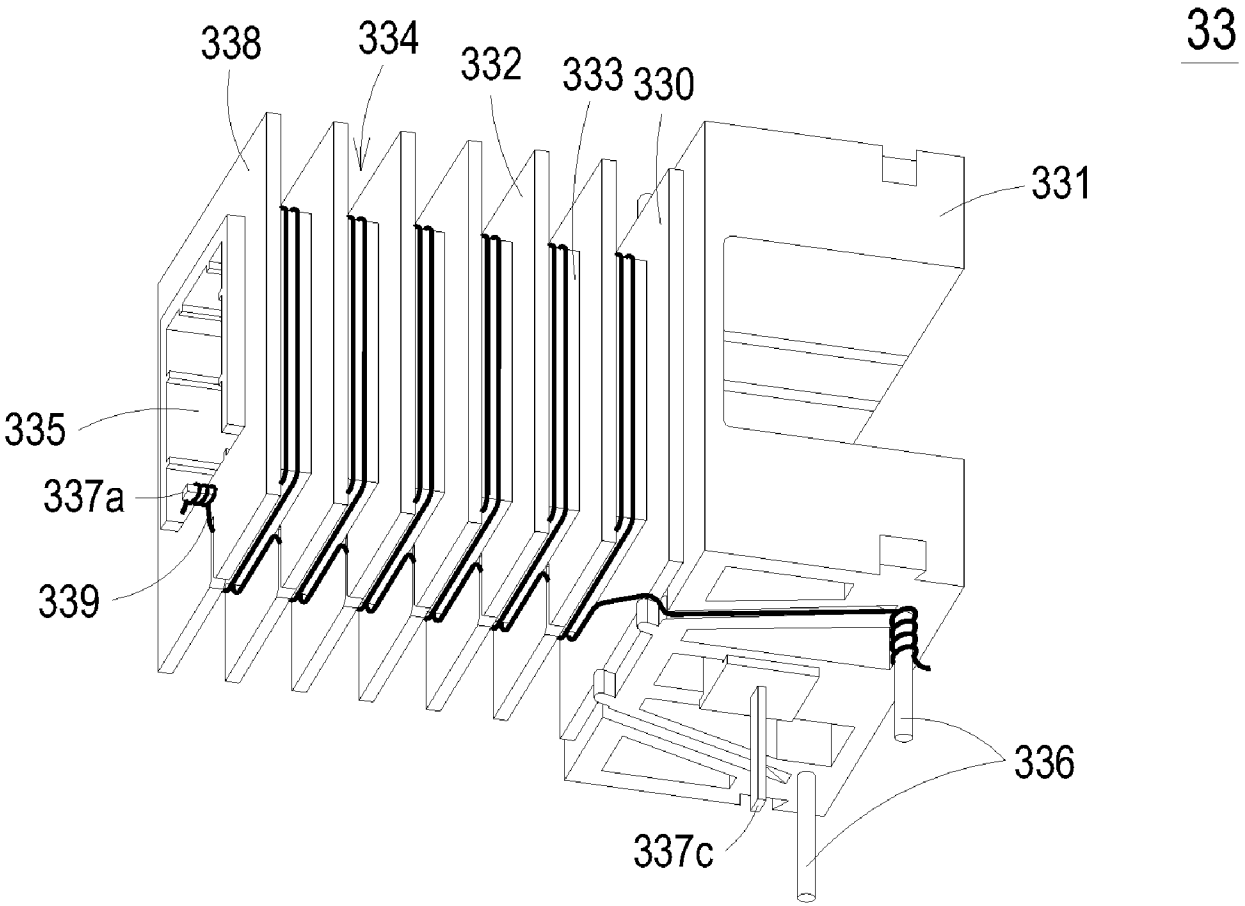
FIG. 4C is a schematic perspective view of the second bobbin piece shown in FIG. 4A having the winding coil wound thereon.

Hereinafter, an embodiment of winding the secondary winding coil 35 will be illustrated as follows with reference to FIG. 4C. First of all, a first terminal of the secondary winding coil 35 is wound on and soldered on the first pin 336. The secondary winding coil 35 is successively wound on the winding sections 334 from the first secondary side plate 330 to the second secondary side plate 338 through the notches 339. After a second terminal of the secondary winding coil 35 is wound on and soldered onto the wire-arranging part 337*a* of the second pin 337, the secondary winding coil 35 is fixed on the second bobbin piece 33. As a consequence, the electricity generated from the secondary winding coil 35 is transmitted from the wire-arranging part 337*a* to the printed circuit board through the insertion part 337*c* and the intermediate part 337*b*. Since the second terminal of the secondary winding coil 35 is soldered onto the wire-arranging part 337*a* of the second pin 337 without the need of returning to the first pin side, the problem of causing high-voltage spark or short circuit is avoided.

Figure 5:
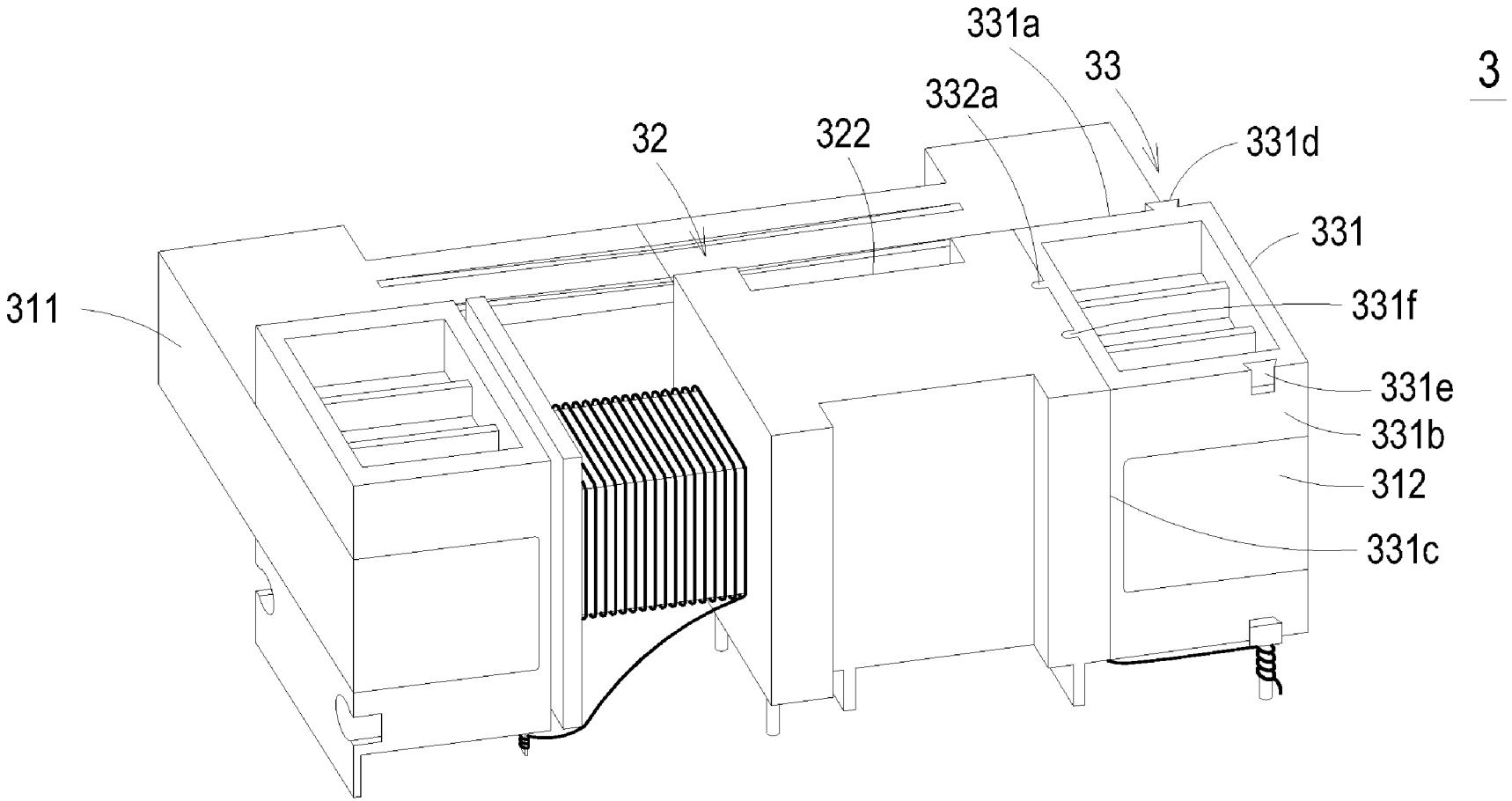
FIG. 5 is a schematic assembled view of the transformer of FIG. 3.

FIG. 5 is a schematic assembled view of the transformer of FIG. 3. As shown in FIG. 5, the secondary base 331 of the second bobbin piece 33 includes a first sidewall 331*a*, a second sidewall 331*b* and a third sidewall 331*c*. A first engaging element 331*d* (e.g. a raised block) is protruded from the first sidewall 331*a*. A second engaging element 331*e* is disposed on the second sidewall 331*b* corresponding to the first engaging element 331*d*. The second engaging element 331*e* (e.g. an indentation) has a complementary shape to the first engaging element 331*d*. Via the first engaging element 331*d* and the second engaging element 331*e*, the transformer 3 can be combined with another transformer (not shown) so that two or more transformers can be arranged in a stack form. Optionally, the third sidewall 331*c* has a third engaging element 331*f* (e.g. a protrusion). In addition, a fourth engaging element 332*a* (e.g. a groove) is formed in the covering element 322 of the first bobbin piece 32 corresponding to the third engaging element 331*f*. When the fourth engaging element 332*a* is engaged with the third engaging element 331*f*, the first bobbin piece 32 and the second bobbin piece 33 are combined together.

For assembling the transformer 3, the second secondary side plate 338 of the second bobbin piece 33 and the secondary winding coil 35 wound on the second bobbin piece 33 are firstly embedded into the receptacle of the covering element 322 of the first bobbin piece 32. Accordingly, the primary winding coil 34 and the secondary winding coil 35 are separated from each other by the covering element 322 and the first channel 323 of the first bobbin piece 32 is communicated with the second channel 335 of the second bobbin piece 33. Next, the fourth engaging element 332*a* of the covering element 322 is engaged with the third engaging element 331*f* of the secondary base 331 of the second bobbin piece 33, the first bobbin piece 32 and the second bobbin piece 33 are combined together. Afterwards, the first leg 311*a* of the first magnetic part 311 and the first leg 312*a* of the second magnetic part 312 are embedded into the first channel 323 of the first bobbin piece 32 and the second channel 335 of the second bobbin piece 33, respectively. The assembled structure of the transformer 3 is shown in FIG. 5.

In the above embodiment, the resulting structure of the transformer 3 is substantially a rectangular solid. The appearance of the overall transformer may be varied according to the utility space and the performance requirement.

Figure 6A:
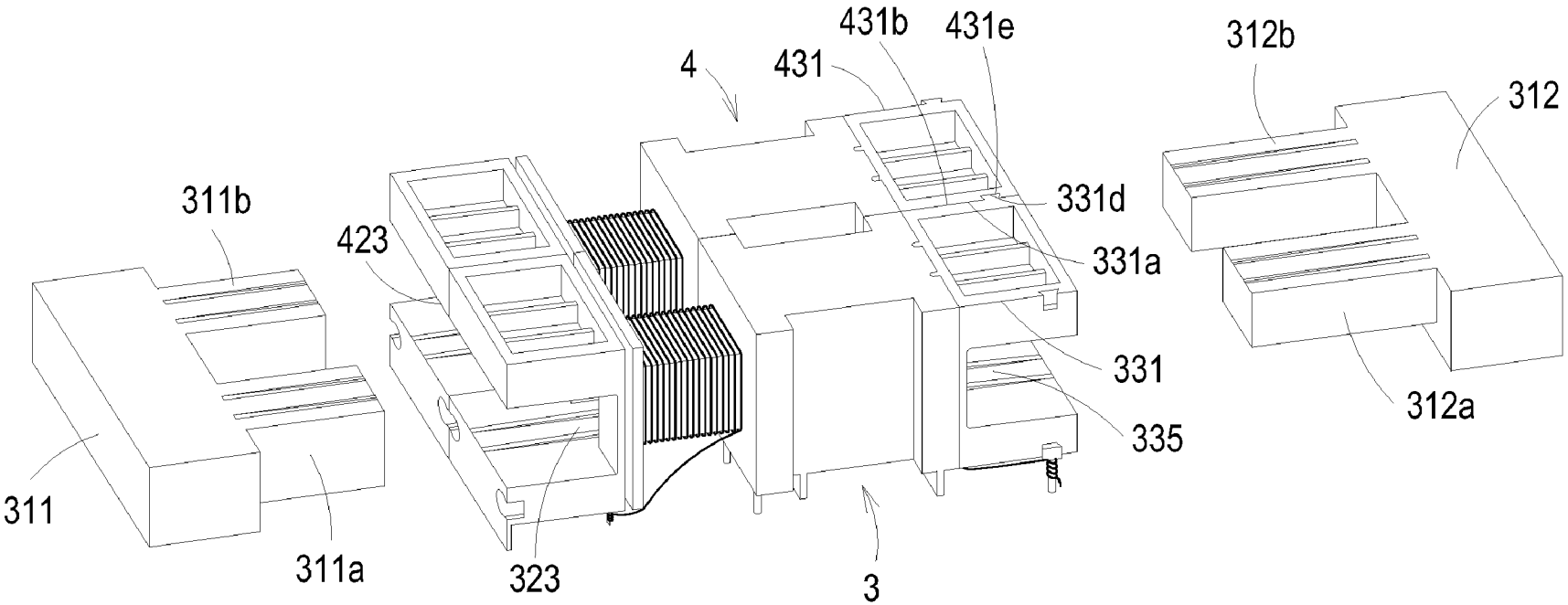
FIG. 6A is an exploded view illustrating a transformer set according to a second preferred embodiment of the present invention.
Figure 6B:
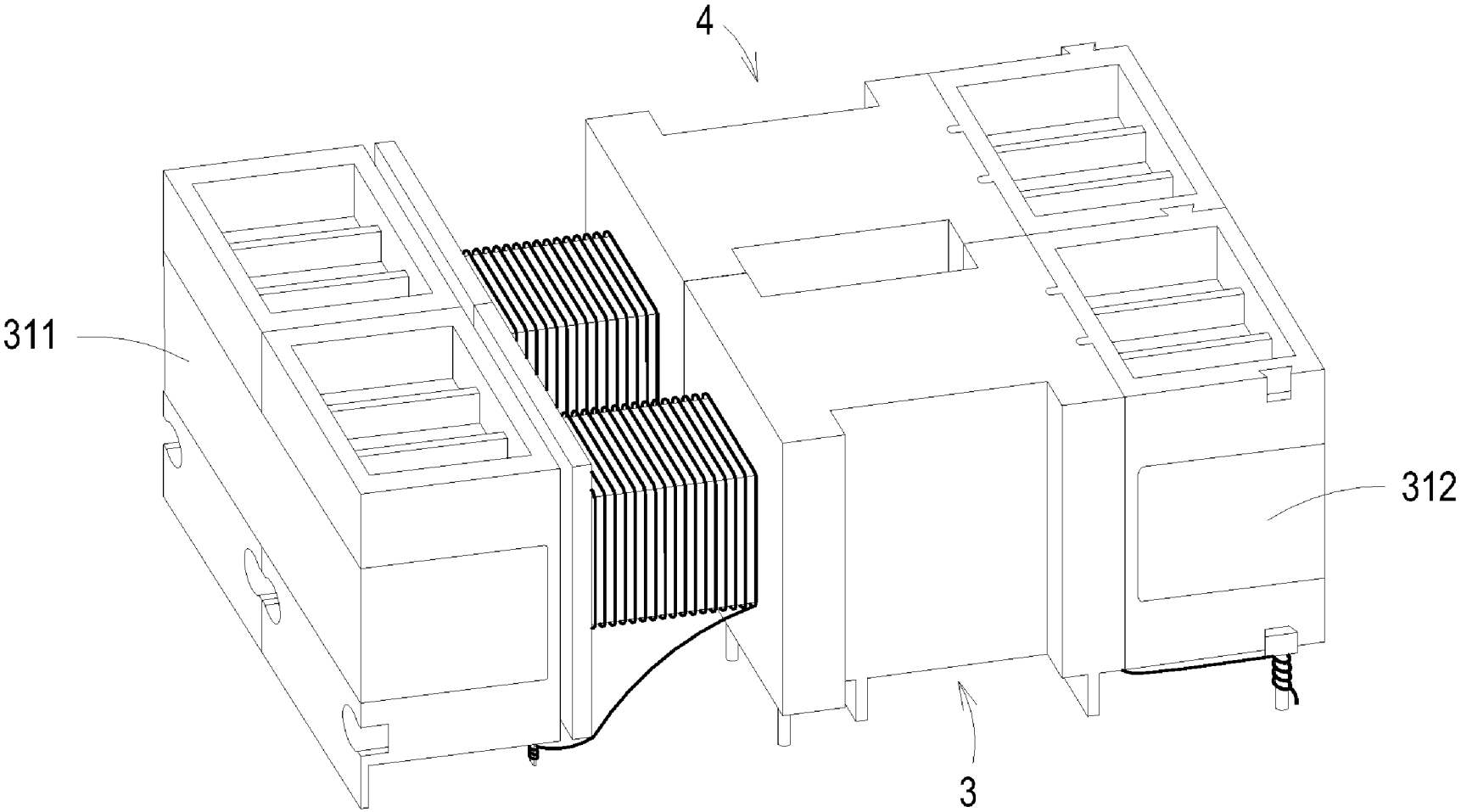
FIG. 6B is a schematic assembled view of the transformer set of FIG. 6A.

FIG. 6A is an exploded view illustrating a transformer set according to a second preferred embodiment of the present invention. In this embodiment, the transformer set is assembled by a first transformer 3 and a second transformer 4, which are arranged in parallel with each other. The first engaging element 331*d* on the first sidewall 331*a* of the secondary base 331 of the first transformer 3 is engaged with the second engaging element 431*e* on the second sidewall 431*b* of the secondary base 431 of the second transformer 4, so that the first transformer 3 and the second transformer 4 are combined together. The first leg 311*a* and the second leg 311*b* of the first magnetic part 311 are embedded into the first channel 323 of the first transformer 3 and the first channel 423 of the second transformer 4, respectively. Likewise, the first leg 312*a* and the second leg 312*b* of the second magnetic part 312 are embedded into the second channel 335 of the first transformer 3 and the second channel (not shown) of the second transformer 4, respectively. The assembled structure of the first transformer 3 and the second transformer 4 is shown in FIG. 6B.

From the above description, since the second terminal of the secondary winding coil is soldered onto the wire-arranging part of the second pin without returning to the first pin side, the problem of causing high-voltage spark or short circuit is avoided. As a consequence, the possibility of causing breakdown of the transformer is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a first bobbin piece having a first channel therein, wherein a primary winding coil is wound on said first bobbin piece;

a second bobbin piece comprising a first secondary side plate, a second secondary side plate opposed to said first secondary side plate, a plurality of partition plates between said first secondary side plate and said second secondary side plate, a wall portion between every two adjacent partition plates, and a secondary base extended from an edge of said first secondary side plate, wherein a secondary winding section is defined by every two adjacent partition plates for winding a secondary winding coil thereon, and a second channel is defined within said wall portion;

a first pin arranged on a bottom surface of said secondary base;

a second pin including a wire-arranging part, an insertion part and an intermediate part between said wire-arranging part and said insertion part, wherein said wire-arranging part is protruded from said second secondary side plate, said intermediate part is buried in said wall portion, said insertion part is protruded from said bottom surface of said secondary base, wherein a first terminal of said secondary winding coil is fixed on said first pin and a second terminal of said secondary winding coil is fixed on said wire-arranging part of said second pin; and a magnetic core assembly partially embedded within said first channel of said first bobbin piece and said second channel of said second bobbin piece.

2. The transformer according to claim 1 wherein said first secondary side plate, said second secondary side plate and said partition plates are parallel with each other.

3. The transformer according to claim 1 wherein each of said partition plates has a notch such that said secondary winding coil is successively wound on said winding section through said notch.

4. The transformer according to claim 1 wherein said secondary base includes a first sidewall, a second sidewall and a third sidewall.

5. The transformer according to claim 4 wherein a first engaging element is formed on said first sidewall of said secondary base.

6. The transformer according to claim 5 wherein said first engaging element is a raised block.

7. The transformer according to claim 5 wherein a second engaging element is formed in said second sidewall of said secondary base corresponding to said first engaging element to be engaged with said first engaging element of another transformer.

8. The transformer according to claim 7 wherein said second engaging element is an indentation.

9. The transformer according to claim 4 wherein a third engaging element is formed on said third sidewall of said secondary base.

10. The transformer according to claim 9 wherein said third engaging element is a protrusion.

11. The transformer according to claim 9 wherein said first bobbin piece further includes a covering element for partially receiving said second bobbin piece therein.

12. The transformer according to claim 11 wherein a fourth engaging element is formed in said covering element of said first bobbin piece corresponding to said third engaging element, wherein said first bobbin piece and said second bobbin piece are combined together when said fourth engaging element is engaged with said third engaging element.

13. The transformer according to claim 12 wherein said fourth engaging element is a groove.

14. The transformer according to claim 11 wherein said first channel of said first bobbin piece is communicated with said second channel of said second bobbin piece after said second bobbin piece is received in said covering element of said first bobbin piece.

15. The transformer according to claim 1 wherein said magnetic core assembly includes a first magnetic part and a second magnetic part.

16. The transformer according to claim 1 wherein said first bobbin piece further comprises a primary side plate, a primary base and a primary winding section, wherein said primary base is extended from an edge of said primary side plate and said primary winding coil is wound on said primary winding section.

17. A bobbin assembly comprising:

a first bobbin piece having a primary side plate, a primary base, a primary winding section and a first channel, said primary base extended from an edge of said primary side plate;

a second bobbin piece comprising a first secondary side plate, a second secondary side plate opposed to said first secondary side plate, a plurality of partition plates between said first secondary side plate and said second secondary side plate, a wall portion between every two adjacent partition plates, and a secondary base extended from an edge of said first secondary side plate, wherein a secondary winding section is defined by every two adjacent partition plates, and a second channel is defined within said wall portion;

a first pin arranged on a bottom surface of said secondary base; and a second pin including a wire-arranging part, an insertion part and an intermediate part between said wire-arranging part and said insertion part, wherein said wire-arranging part is protruded from said second secondary side plate, said intermediate part is buried in said wall portion, said insertion part is protruded from said bottom surface of said secondary base.

18. The bobbin assembly according to claim 17 wherein said first bobbin piece further includes a covering element opposed to said primary side plate for partially receiving said second bobbin piece therein.

19. The bobbin assembly according to claim 18 wherein said primary winding section is defined by said covering element and said primary side plate.

20. The bobbin assembly according to claim 17 wherein said first bobbin piece and said second bobbin piece are combined together by engagement.

* * * * *

UNITED STATES PATENT AND TRADEMARK OFFICE

CERTIFICATE OF CORRECTION

PATENT NO. : 7,515,026 B1
APPLICATION NO. : 12/036921
DATED : April 7, 2009
INVENTOR(S) : Tzu-Yang Liu It is certified that error appears in the above-identified patent and that said Letters Patent is hereby corrected as shown below:

Column 5 line 3, "535" should be changed to --35--;
Column 5 line 7, delete "first".

Signed and Sealed this

Twenty-ninth Day of June, 2010

David J. Kappos

David J. Kappos
*Director of the United States Patent and Trademark Office*